United States Patent [19]

Child et al.

[11] 4,436,530

[45] Mar. 13, 1984

[54] PROCESS FOR GASIFYING SOLID CARBON CONTAINING MATERIALS

[75] Inventors: Edward T. Child, Tarrytown; William B. Crouch, Chappaqua, both of N.Y.

[73] Assignee: Texaco Development Corporation, White Plains, N.Y.

[21] Appl. No.: 394,974

[22] Filed: Jul. 2, 1982

[51] Int. Cl.[3] ..... C10J 3/46

[52] U.S. Cl. ..... 48/197 R; 48/206; 252/373; 423/415 A; 423/655

[58] Field of Search ..... 48/197 R, 200, 201, 48/202, 206, 210, 209, DIG. 7; 252/373; 423/415 A, 655, 656

[56] References Cited

U.S. PATENT DOCUMENTS

| | | | |
|---|---|---|---|
| 3,998,609 | 12/1976 | Crouch et al. | 48/200 |
| 4,205,963 | 6/1980 | Marion et al. | 48/197 R |
| 4,248,604 | 2/1981 | Woldy et al. | 48/197 R |
| 4,251,228 | 2/1981 | Muenger et al. | 48/197 R |

*Primary Examiner*—Peter F. Kratz

*Attorney, Agent, or Firm*—Robert A. Kulason; Robert Knox, Jr.; Carl G. Seutter

[57] ABSTRACT

Synthesis gas is produced by partial oxidation of slurried coal followed by separation of ash, the temperature of the gas being thereafter controlled to permit a desired portion thereof to be directly contacted with water to achieve a gas/stream mixture of predetermined composition prior to shift conversion, the other portion being preferably convectively cooled for maximum thermal efficiency and then scrubbed prior to withdrawal as carbon monoxide-containing product.

17 Claims, 1 Drawing Figure

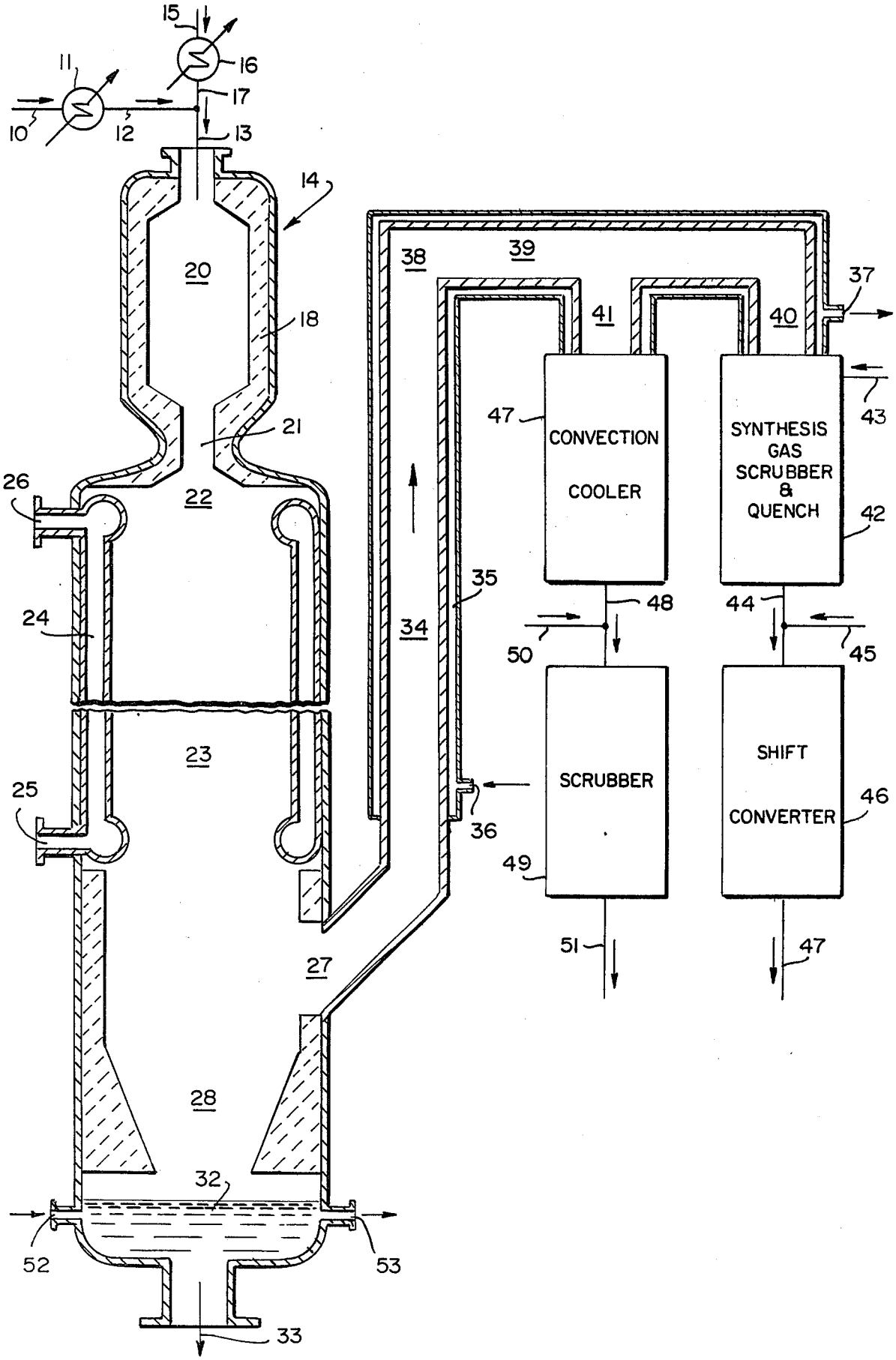
CONVECTION COOLER
SYNTHESIS GAS SCRUBBER & QUENCH
SCRUBBER
SHIFT CONVERTER

PROCESS FOR GASIFYING SOLID CARBON CONTAINING MATERIALS

FIELD OF THE INVENTION

This invention relates to the thermally efficient production of synthesis gas by the gasification of coal.

BACKGROUND OF THE INVENTION

Gasification of coal may produce a product gas stream which finds use in a wide variety of processes. It is possible, for example, to utilize the partial oxidation products of coal gasification to provide a feed gas stream for operations which utilize, (i) a carbon monoxide-containing stream as charge to a chemical process, (ii) a hydrogen-containing stream as charge to a hydrogenation-type operation, (iii) a stream containing carbon monoxide and hydrogen as charge to e.g. an alcohol production operation, etc. When the product gas from coal gasification is to be used in several of these processes (i.e. when some of the gas is to go to e.g. a chemical plant requiring a charge carbon monoxide feed and some is to go via a shift converter to a chemical synthesis operation), thermal inefficiencies arise due to the differences in temperature and chemical constituents required for the designated reactions and the techniques required to effect the necessary changes in temperature and composition of the gas stream.

It is an object of this invention to provide a process and apparatus wherein high process efficiencies are attained. Other objects will be apparent to those skilled-in-the-art.

STATEMENT OF THE INVENTION

In accordance with certain of its aspects, this invention is directed to a process which comprises gasifying a solid carbon-containing charge in the presence of water and an oxygen-containing gas thereby forming a hot synthesis gas containing carbon monoxide and hydrogen at 1100° C.–1600° C.;

cooling by radiation said hot synthesis gas containing carbon monoxide and hydrogen to 500° C.–800° C. thereby forming a partially cooled synthesis gas;

removing at least a portion of the ash components from said partially cooled synthesis gas thereby forming a partially deashed cooled synthesis gas;

convectively cooling said partially deashed cooled synthesis gas in a transfer line convection cooler from initial temperature of 500° C.–800° C. to a final temperature of 400° C.–700° C. thereby forming a further cooled synthesis gas;

convectively cooling a first, carbon monoxide-production portion of said further cooled synthesis gas to 150° C.–400° C. thereby forming a convectively cooled first portion;

scrubbing said convectively cooled first portion thereby forming a scrubbed first portion of said synthesis gas in amount desired for carbon monoxide production;

contacting a second portion of said cooled synthesis gas with aqueous coolant in synthesis gas scrubbing and quench operation wherein, as said gas is cooled from 500° C.–800° C. down to 150° C.–250° C., it volatilizes thereinto water in predetermined desired amount for shift conversion thereby forming a shift conversion charge gas;

preheating said shift conversion charge gas to 175° C.–250° C.;

passing said preheated shift conversion charge gas to a shift conversion operation wherein at 250° C.–550° C. and 300–1200 psig, in the presence of catalyst, steam reacts with carbon monoxide forming carbon dioxide and hydrogen to yield a product synthesis gas; and withdrawing said product synthesis gas.

DESCRIPTION OF THE INVENTION

The charge to the process of this invention includes solid carbonaceous fuels which contain ash. Typical of such fuels are coals including anthracite, bituminous, sub-bituminous, lignite, coke from coal, petroleum coke, particulate carbon, tar sand, asphalt, pitch etc. Typically, these coals may contain ash in amounts as little as 0.1 w %–0.5 w % or as much as 20 w %–40 w %. They may also contain water in amounts as low as 0 w %–10 w % or as much as 30 w %–40 w % or more. Although the charge coal may be used without reducing the moisture content, it is preferred, to facilitate grinding and slurrying in the case of these coals containing large amounts of water to pre-dry the coal to a mositure content to 2 w %–20 w % depending on the nature of the coal.

The charge coal may be ground to a particle size so that preferably 100% passes through a 14 mesh sieve and greater than 50 w % has a particle size within the range of 14–325 mesh sieve.

The ground solid fuel may be employed as charge; but preferably it is slurried in a liquid vaporizable hydrocarbon or water or it is entrained in a gaseous medium. Typical liquid vaporizable hydrocarbons which may be employed include various oils derived from petroleum including distillates and residues such as crude petroleum, reduced crude, gas oil, cycle gas oil, coker gas oil, furfural extract of coker gas oil, etc; oil derived from coal, tar sands, lignite; etc. When such liquids are employed, the slurry may include 100 parts of solid coal or coke with 40–150 parts, preferably 50–100 parts, say 55 parts of liquid.

The preferred slurrying agent is water and it is preferably present in the charge to gasification in amount of 30–120 parts per 100 parts of solid coal or coke.

Alternatively, the ground solid fuel may be entrained in a gas such as steam, carbon dioxide, nitrogen, recycle synthesis gas, air, etc.

If desired, there can also be charged a supplemental temperature moderator to moderate the temperature in the reaction zone. Moderators may be particularly desirable when the charge includes liquid vaporizable hydrocarbons. When employed, they may be admitted with any of the charge streams or separately. Typical temperature moderators may include superheated steam, saturated steam, unsaturated steam, water, carbon dioxide-rich gas, cooled exhaust from downstream turbines, nitrogen-in-air, by-product nitrogen from a conventional air separation unit, etc.

Charge also includes a free-oxygen-containing gas. Typical of such gases which contain at least about 21 w % oxygen include air, oxygen-enriched air (containing more than 21 w % oxygen), substantially pure (e.g. greater than 95 w %) oxygen, etc. Commonly, this gas contains oxygen plus other gases derived from the air from which the oxygen was prepared.

Total charge commonly contains the following parts by weight:

TABLE

| Component | Parts Broad | Preferred | Typical |
|---|---|---|---|
| Solid Fuel | — | — | 100 |
| Slurrying Liquid | 30–150 | 30–120 | 75 |
| Oxygen-containing Gas atoms of free oxygen per atom of carbon | 0.7–1.6 | 0.8–1.4 | 1 |
| Moderator | 0.5–2.0 | 0.7–1.0 | 0.85 |
| Total Water | 0–150 | 40–100 | 75 |

The atomic ratio of oxygen (in the free-oxygen-containing gas) to carbon (in the solid fuel) may be 0.7–1.6. When the fuel-oxygen-containing gas in substantially pure oxygen, the ratio may be 0.7–1.5. When it is air, the ratio may be 0.8–1.6. When water is the temperature moderator as in the case when liquid hydrocarbon is used as slurrying medium, the weight ratio of water to carbon in the fuel may be 0.5–2.0, preferably 0.7–1.0, say 0.9.

In typical operation, the total charge might contain 100 parts of ground anthracite, 60 parts of water as slurrying fluid, no temperature moderator, and sufficient air to attain an atom ratio of 1.3 free oxygen to carbon in the fuel. In another operation, the total charge might contain 100 parts of ground bituminous, 100 parts of light cycle gas oil, 160 parts of superheated steam and sufficient enriched air containing 80 w % oxygen to attain a ratio of 1.0 free oxygen atoms per atom of carbon in the fuel.

In practice of the process of this invention, the charge carbon-containing slurry is heated to 25° C.–300° C., say 80° C. prior to admission to gasification; and the free-oxygen-containing gas may be heated to 25° C.–500° C., say 80° C. When employed, the supplemental temperature moderator may be heated to 25° C.–300° C., say 270° C.

The charge material, typically slurry, free-oxygen-containing gas, and moderator are admitted to a partial oxidation synthesis gas generation, typified by that set forth in U.S. Pat. No. 2,818,326 to Texaco as assignee of Eastman et al. This generator includes an annulus-type burner (such as is typified by that set forth in U.S. Pat. No. 2,928,460 to Texaco as assignee of Eastman et al) in a vertical cylindrical steel pressure vessel lined with a thermal refractory material.

As the charge components are admitted to the reaction vessel-combustion chamber, incomplete combustion is effected to yield a product hot raw gas which principally contains hydrogen, carbon monoxide, steam and carbon dioxide. Other materials which may typically be present may include hydrogen sulfide, carbonyl surlfide (COS), methane, ammonia, nitrogen, and inert gases typified by argon.

The principal gaseous components, in the product may include the following (volume % on a dry basis) when substantially pure oxygen is fed to the combustion chamber:

TABLE

| Component | Broad | Typical |
|---|---|---|
| Carbon Monoxide | 30–60 | 47 |
| Hydrogen | 5–40 | 36 |
| Carbon Dioxide | 5–35 | 15 |
| Hydrogen Sulfide + COS | 0–5 | 1 |
| Nitrogen | 0–5 | 1 |
| Methane | 0–2 | 0.2 |

TABLE-continued

| Component | Broad | Typical |
|---|---|---|
| Inert Gases | 0–1.5 | 0.1 |

When air replaces the pure oxygen, the composition may be as follows (volume % dry basis):

TABLE

| Component | Broad | Typical |
|---|---|---|
| Carbon Monoxide | 10–35 | 16 |
| Hydrogen | 2–20 | 11 |
| Carbon Dioxide | 5–25 | 10 |
| Hydrogen Sulfide + COS | 0–3 | 0.5 |
| Nitrogen | 45–70 | 62 |
| Methane | 0–2 | 0.1 |
| Inert Gases | 0.1–1.5 | 0.8 |

The autogenous temperature in the combustion chamber of the gas generation zone may be 1100° C.–1600° C., say 1400° C. at 100–1500 psig, preferably 500–1200 psig, say 900 psig. Residence time for gasification may be 1–10 seconds, preferably 1–7 seconds, say about 3–5 seconds.

In addition to molten slag, the product synthesis gas is found to contain a particulate ash phase containing about 0.1 w %–20 w % of the organic carbon in the feed and typically about 1 w %–4 w %, say 2 w %. This particulate phase may correspond to about 0.5–20 grams, say 5 gram per normal cubic meter of gas.

The hot raw product synthesis gas leaves typically through a centrally positioned outlet in the bottom of the reaction zone, the outlet being coaxial with the central longitudinal axis of the reaction zone-gas generator. The gas passes downwardly through a bottom outlet zone and then is admitted to the upper position of a radiant cooler. The temperature of the gas as it is admitted to the radiant cooler is 1100° C.–1600° C., say 1400° C. The linear velocity of the gas decreases as it enters the radiant cooling operation which is preferably located directly below and is coaxial with the central vertical axis of the reaction zone of the gas generator.

The radiant cooling chamber includes a refractory lining and a means for removing radiant heat impinging on the refractory liner. This preferably includes a heat exchanger surface made up a series of connected tubes arrayed preferably parallel to the main axis of the chamber. Heat exchange fluid passes through these tubes.

As the synthesis gas passes through the radiant cooling chamber, it is cooled by radiation typically to 500° C.–800° C., say 600° C. Ash contained therein is projected by velocity and gravity heads in a downward direction to permit it to pass along the axis of the cooling chamber toward the outlet. The tubes of the radiant cooling chamber may undesirably collect ash depositing thereon; and to minimize this, there may be provided a plurality of soot-blowing nozzles spaced adjacent to the tubes by means of which steam or inert gas may be directed onto the tubes to thereby remove ash and soot which deposits thereon.

The ash is preferably directed downwardly through and out of the radiant cooling chamber into an ash collection zone wherein the ash is cooled and collected. Preferably the ash collection zone includes a lower collection area wherein ash accumulates in a pool of water to be withdrawn. Water is admitted to the ash collection zone and the cooled ash is collected and withdrawn as a slurry in water.

The synthesis gas which leaves the bottom portion of the radiant cooling chamber (above the ash-collection zone) at temperatures of 500° C.–800° C., say 600° C. is withdrawn and passes through a transfer line to a synthesis gas scrubber. It is a feature of the process of this invention that the synthesis gas passing from the bottom portion of the radiant cooling chamber to the synthesis gas scrubber be passed laterally to and thence through a water-jacketed transfer line cooler. In the preferred embodiment, the transfer line is surrounded by a water jacket for cooling water over substantially the entire length of the transfer line between the radiant cooling chamber and the synthesis gas scrubber (and also the convection cooler discussed infra).

During passage of the gas through the transfer line cooler, the gas is convectively cooled (preferably against boiler feed water which may thereby be heated and vaporized) to a point at which the heat content thereof is such that when it is contacted with water in the subsequent synthesis gas scrubbing operation, water is vaporized to provide in the gas substantially the amount of water desired for subsequent operation of the shift converter.

In practice, this is effected if transfer line cooling lowers the temperature of the gas to a point so that when it is admitted to synthesis gas scrubbing, it is at temperature of 400° C.–700° C., say 500° C.

Control of the temperature of the gas makes it possible to load the gas with the desired amount of water during the cooling which occurs in the synthesis gas scrubber.

The gas exiting the transfer line is divided into a first portion and a second portion. The first portion, which may be 10 w %–90 w %, say 50 w % of the total gas, is that amount of the total gas which, as dictated by external needs of the system, is required for production of carbon monoxide. The remaining portion 90 w %–10 w %, say 50 w % of the total may be used to prepare synthesis gas which is to be passed to e.g. chemical production.

The first portion of the synthesis gas exiting the transfer line cooler is passed at 400° C.–700° C., say 500° C. and 300–1200 psig, say 900 psig through a convection cooler wherein by indirect heat exchange against process fluid (such as boiler feed water) or cooling water it is cooled to 150° C.–400° C., say 250° C.

The so-cooled gas may then be passed through a scrubbing operation wherein by contact with water, it is further cooled to 100° C.–200° C., say 150° C. The further cooled gas is withdrawn and passed to carbon-monoxide purification, or it may be subsequently used as fuel for combustion, etc.

The second portion of synthesis gas exiting the transfer line cooler in amount of 90–10 wt. %, say 50 wt. %. This gas stream is contacted with scrubbing liquid, typically water, at a temperature of 150° C.–240° C., say 230° C. During scrubbing, the synthesis gas picks up water vapor to a point at which the mole ratio of carbon monoxide to water, in the gas leaving scrubbing, of predetermined desired amount i.e. 2.0–5.0:1, say 3.5:1. When conditions dictate, this ratio may be achieved by adding slight additional quantities of steam (up to typically 30 v % of that desired) to the gas leaving the scrubbing operation.

Gas exiting the synthesis gas scrubber, at 150° C.–240° C., say 230° C. and 300–1200 psig, say 900 psig is passed to a preheating operation wherein it is preheated to 175° C.–250° C., say about 240° C.; and the preheated gas is then passed to shift conversion operation. Here carbon monoxide and steam react to form hydrogen and carbon dioxide and to yield a gas containing the following (in volume %):

TABLE

| Component | Broad | Typical |
|---|---|---|
| Carbon monoxide | 0.4–5.0 | 3.5 |
| Hydrogen | 40–70 | 60 |
| Carbon Dioxide | 20–40 | 35 |
| $H_2S$ plus COS | 0–5 | 1 |
| Inert gas including $N_2$ | 0–6 | 1 |
| Methane | 0–3 | 0.2 |

Shift conversion may be exothermically effected in the presence of catalyst such as cobalt molybdate (Co-Mo) on aluminum at 250° C.–550° C., say 400° C. and 300–1200 psig, say 900 psig.

Shifted synthesis gas leaving shift conversion reactors at 450° C.–550° C., say 500° C. and 300–1200 psig, say 900 psig may be recovered and passed typically to a synthesis gas chemical production operation.

It is a feature of the process of this invention that in case of the need to shut down the convection cooler through which passes the first portion of the gas leaving the transfer line cooler, it is possible as by opening and closing valves to direct the flow of gas so that the entire flow passes to the synthesis gas scrubber and quench, and optionally to the shift converter.

ADVANTAGES OF THE INVENTION

The primary advantage of the process of this invention is that it has the flexibility to produce both (i) a raw synthesis gas (of low steam content) suitable for carbon monoxide production and (ii) also a raw synthesis (of high steam content) suitable for end products requiring a high hydrogen content in the synthesis gas which is to be passed to a shift converter. The process permits maximum recovery of valuable by-product steam, resulting in a thermally efficient process.

DESCRIPTION OF THE DRAWINGS

FIG. 1 of the drawings represents a schematic flow sheet of the best mode presently known of practicing the process of this invention.

DESCRIPTION OF PREFERRED EMBODIMENT

Practice of the process of this invention will be apparent to those skilled in the art from the following description including FIG. 1 which is a schematic flow sheet of the best mode known to me of practicing the process of the invention. All parts are parts by weight unless otherwise stated.

In this preferred embodiment, the carbon containing charge material is a bituminous coal containing 70 w % carbon and 14 w % ash. This coal is ground to a fineness such that 100 w % passes through a 14 mesh sieve. Greater than 50% will have a particle size within the range of 14–325 mesh sieve. 100 parts of the product coal are slurried in 60 parts of water. This slurry in line 10 heated in heat exchanger 11 to 65° C. and passed through lines 12 and 13, through a burner not shown, into the upper end of vertically positioned gasification vessel 14.

There is also admitted through line 15 an oxygen stream containing 99.5 v % oxygen at 20° C. This oxygen stream is passed through heat exchanger 16 wherein its heated to 120° C. and then through lines 17 and 13 to vessel 14. In this embodiment, no temperature moderator is employed.

In gasification vessel 14, which is fitted with thermally resistant lining 18 which defines combustion chamber 20, incomplete combustion is effected to yield a product hot raw gas containing the following parts by volume:

TABLE

| Component | Vol. % |
|---|---|
| Carbon Monoxide | 47.0 |
| Hydrogen | 35.6 |
| Carbon Dioxide | 15.0 |
| Hydrogen Sulfide + COS | 1.3 |
| Nitrogen | 0.7 |
| Methane | 0.2 |
| Argon | 0.2 |

In addition to molten slag, the gas contains solids in amount of five grams of ash per normal cubic meter of dry gas. Average temperature in combustion chamber 20 may be 1370° C. Temperature of the hot raw gas leaving combustion chamber 20 through outlet zone 21 at the bottom thereof may be 1370° C.

The gas leaving outlet zone 21 of combustion chamber 20 passes downwardly into the top portion 22 of radiant cooler 23 which includes a plurality of vertically upstanding tubes 24 through which cooling liquid passes from inlet 25 to outlet 26. As the raw hot gas passes through this radiant section, it is cooled principally by radiation; and as it reaches the exit area 27 at which point it leaves the radiant cooler 23, the temperature is at 600° C.

Because of the velocity head and the gravity head in the gases passing through outlet zone 21, the ash in the gas is directed downwardly through radiant cooler 23. Ash which undesirably collects on the tubes 24 or other portions of the walls of radiant cooler 23 may be removed by soot-blowing nozzles (not shown) which project a high velocity jet of gas onto the tubes or walls and thereby remove any ash deposited thereon.

The ash is directed downwardly to ash collection area 28. The ash, which enters this ara 28 in generally solid phase at 600° C., passes downwardly therethrough. It is collected in pool 32 to which water is admitted through line 52. A slurry of ash and water is periodically withdrawn through line 33. Excess water may be withdrawn through line 53.

It is a feature of this invention that synthesis gas at 600° C. leaves exit area 27 and passes laterally into transfer line cooler 34 which is cooled by passage of cooling liquid through jacket 35. Transfer line cooling, which is principally convective cooling, is controlled by monitoring the temperature and flow of liquid entering at 36 and leaving at 37—schematically shown. In practice of the process of this invention, the temperature of this gas is controlled between outlet zone 21 and the admission to the downstream synthesis gas scrubber at 40 so that the heat content of the gas entering the synthesis gas scrubber is sufficient to volatilize into the gas passed through the synthesis gas scrubber an amount of water which is substantially equivalent to the amount desired to be admitted with the gas to the subsequent shift converter.

The gas leaving transfer line cooler 34 through line 38 is passed through lines 39 and 40 to synthesis gas scrubber and quench 42. In practice, the transfer line 34 will be a jacketed conduit over substantially its entire length, including those sections designated 34, 38, 39, 40, and 41 from the point at which the transfer line 34 joins exit area 27 to the point of admission to synthesis scrubber 42 (and also the convection cooler referred to infra).

Gas enters synthesis scrubber 42 through line 40 at 500° C. There is admitted through line 43 scrubbing water at 230° C. In scrubber 42, the contact between the scrubbing water and the gas volatilizes into the gas water in amount sufficient to raise the water content of the gas to about 3.5 moles of steam per mole of carbon monoxide, which is about the amount desired in the subsequent shift converter operation. The gas is cooled in the synthesis gas scrubber to 230° C.

Gas exiting the synthesis gas scrubber 42 through line 44 is passed to shift conversion operation 46. When necessary or desirable, there may be added additional steam through line 45 to the stream charged to shift converter 46. The latter contains cobalt molybdate-on-aluminum as shift catalyst. As the charge gas, which has been preheated to 240° C., passes through the shift converter, the principal reaction includes that between water and carbon monoxide to produce carbon dioxide and hydrogen. Typical synthesis gas removed through line 47 includes the following:

TABLE

| Component | Parts (volume) |
|---|---|
| Carbon Monoxide | 3.5 |
| Hydrogen | 60 |
| Carbon Dioxide | 35 |
| $H_2S$ plus COS | 1 |
| Inert gas including $N_2$ | 1 |
| Methane | 0.2 |

In practice of this embodiment of the invention, a desired portion, say 10 w % of the gas in line 39 is withdrawn through line 41 to be used as net carbon monoxide product for use in production of chemicals based on carbon monoxide. It will be apparent to those skilled in the art that valves may be present in the various lines including lines 40, 41, 44, 47, 48 and 51 to permit desired control of the flow of gas. This stream at 500° C. is passed through convection cooler 47 wherein it is cooled to 150° C. and then through line 48 to scrubber 49 wherein it is contacted with cooling water from line 50. Net product carbon monoxide production may be withdrawn through line 51.

It is be apparent to those skilled in the art that the novel process of this invention permits control of the composition of the charge to shift conversion which permits that operation to function at high efficiency.

Although this invention has been illustrated by reference to specific embodiments, it will be apparent to those skilled in the art that various changes and modifications may be made which clearly fall within the scope of this invention.

We claim:

1. The method which comprises gasifying a solid carbon-containing charge in the presence of water and an oxygen-containing gas thereby forming a hot synthesis gas containing carbon monoxide and hydrogen at 1100° C.–1600° C.;

cooling by radiation said hot synthesis gas containing carbon monoxide and hydrogen to 500° C.–800° C. thereby forming a cooled synthesis gas;

removing at least a portion of the ash components from said cooled synthesis gas thereby forming a partially deashed cooled synthesis gas;

convectively cooling said partially deashed cooled synthesis gas in a transfer line convection cooler from initial temperature of 500° C.–800° C. to a final temperature of 400° C.–700° C. thereby forming a further cooled synthesis gas;

convectively cooling a first, carbon monoxide-production portion of said further cooled synthesis gas to 150° C.–400° C. thereby forming a convectively cooled first portion;

scrubbing said convectively cooled first portion thereby forming a scrubbed first portion of said synthesis gas in amount desired for carbon monoxide production;

contacting a second portion of said cooled synthesis gas with aqueous coolant in a synthesis gas scrubbing and quench operation wherein, as said gas is cooled from 400° C.–700° C. down to 150° C.–250° C., it volatilizes therein water in predetermined desired amount for shift conversion thereby forming a shift conversion charge gas;

preheating said shift conversion charge gas to 175° C.–250° C.;

passing said preheated shift conversion charge gas to a shift conversion operation wherein at 250° C.–550° C. and 300–1200 psig water reacts with carbon monoxide forming carbon dioxide and hydrogen to yield a product synthesis gas; and withdrawing said product synthesis gas.

2. The method claimed in claim 1 wherein said solid carbon-containing charge is anthracite coal.

3. The method claimed in claim 1 wherein said solid carbon-containing charge is a bituminous coal.

4. The method claimed in claim 1 wherein said solid carbon-containing charge is a lignite.

5. The method claimed in claim 1 wherein said solid carbon-containing charge is a delayed petroleum coke.

6. The method claimed in claim 1 wherein said solid carbon-containing charge is a fluid petroleum coke.

7. The method claimed in claim 1 wherein said solid carbon-containing charge is sub-bituminous coal.

8. The method claimed in claim 1 where said solid carbon-containing charge is ground to a particle size such that about 100% of the coal passes through a 14-mesh sieve.

9. The method claimed in claim 1 wherein said solid carbon-containing charge is passed to gasification as a slurry in water.

10. The method claimed in claim 1 wherein said solid carbon-containing charge is passed to gasification is a slurry in liquid vaporizable hydrocarbon.

11. The method claimed in claim 1 wherein said solid carbon-containing charge is passed to gasification entrained in gas stream.

12. The method claimed in claim 1 wherein a temperature moderator is admitted to gasification to moderate the temperature in the reaction zone of said gasification zone.

13. The method claimed in claim 1 wherein oxygen-containing gas is air.

14. The method claimed in claim 1 wherein oxygen-containing gas is oxygen-enriched air containing more than 21 wt % oxygen.

15. The method claimed in claim 1 wherein oxygen-containing gas is substantially pure oxygen.

16. The method claimed in claim 1 wherein at least a portion of the ash components in the cooled synthesis gas leaving the radiant cooling operation are downwardly directed by velocity and gravity lead into an ash collecting zone and the cooled synthesis gas is laterally withdrawn from said stream of ash components.

17. The method which comprises gasifying a slurried bituminous charge, of particle size such that 100% passes through a 14-mesh sieve, in the presence of water and oxygen thereby forming a hot synthesis gas containing carbon monoxide and hydrogen at 1100° C.–1600° C.;

cooling by radiation said hot synthesis gas containing carbon monoxide and hydrogen to 500° C.–800° C. thereby forming a cooled synthesis gas;

passing said cooled synthesis gas downwardly out of said radiant cooling operation thereby directing ash in a downwardly directed stream by velocity and gravity head toward an ash collecting zone and forming a partially deashed cooled synthesis gas;

withdrawing said partially deashed cooled synthesis gas laterally of said downwardly directed stream;

convectively cooling said partially deashed cooled synthesis gas in a transfer line convection cooler from initial temperature of 500° C.–800° C. to a final temperature of 400° C.–700° C. thereby forming a further cooled synthesis gas;

convectively cooling a first, carbon monoxide-production portion of said further cooled synthesis gas to 150° C.–400° C. thereby forming a convectively cooled first portion;

scrubbing said convectively cooled first portion thereby forming a scrubbed first portion of said synthesis gas in amount desired for carbon monoxide production;

contacting a second portion of said cooled synthesis gas with aqueous coolant in a synthesis gas scrubbing and quench operation wherein, as said gas is cooled from 400° C.–700° C. down to 150° C.–250° C., it volatilizes thereinto water in predetermined desired amount for shift conversion thereby forming a shift conversion charge gas;

preheating said shift conversion charge gas to 175° C.–250° C.;

passing said shift conversion charge gas to a shift conversion operation wherein at 250° C.–550° C. and 300–1200 psig, in the presence of a catalyst, water reacts with carbon dioxide forming carbon monoxide and hydrogen to yield a product synthesis gas; and withdrawing said product synthesis gas.

* * * * *

UNITED STATES PATENT AND TRADEMARK OFFICE

CERTIFICATE OF CORRECTION

PATENT NO. : 4,436,530

DATED : March 13, 1984

INVENTOR(S) : T. CHILD and W. CROUCH

It is certified that error appears in the above—identified patent and that said Letters Patent is hereby corrected as shown below:

| Column | Line | |
|---|---|---|
| 1 | 62 | after "said", |
| 9 | 14 | insert -- further -- |
| 10 | 43 | |
| 10 | 55 | "dioxide" should read -- monoxide --; |
| | 56 | "monoxide" should read -- dioxide -- |

Signed and Sealed this

*Thirty-first* Day of *July 1984*

[SEAL]

*Attest:*

GERALD J. MOSSINGHOFF

*Attesting Officer*

*Commissioner of Patents and Trademarks*